US007854984B2

(12) United States Patent
O'Brien et al.

(10) Patent No.: US 7,854,984 B2
(45) Date of Patent: Dec. 21, 2010

(54) WEAR-RESISTANT DECORATIVE LAMINATES

(75) Inventors: Kevin Francis O'Brien, Cincinnati, OH (US); Frederic Auguste Taillan, Cincinnati, OH (US)

(73) Assignee: The Diller Corporation, Cincinnati, OH (US)

( * ) Notice: Subject to any disclaimer, the term of this patent is extended or adjusted under 35 U.S.C. 154(b) by 751 days.

(21) Appl. No.: 11/120,870

(22) Filed: May 3, 2005

(65) Prior Publication Data

US 2006/0251870 A1 Nov. 9, 2006

(51) Int. Cl.
*B05D 7/00* (2006.01)

(52) U.S. Cl. ..... 428/212; 428/328; 428/195.1; 428/204; 428/524; 428/844.2; 428/844.3; 428/323; 428/143

(58) Field of Classification Search ..... 428/524, 428/195.1, 204, 143, 323, 844.2, 844.3, 212
See application file for complete search history.

(56) References Cited

U.S. PATENT DOCUMENTS 4,430,375 A 2/1984 Scher et al.
4,713,138 A 12/1987 Ungar et al.
4,880,689 A 11/1989 Park et al.
4,881,951 A * 11/1989 Monroe et al. ..... 51/309
4,971,855 A 11/1990 Lex et al.
5,047,282 A * 9/1991 Mier ..... 428/204
5,102,429 A * 4/1992 Wald et al. ..... 51/295
5,141,799 A 8/1992 Mehta et al.
5,266,384 A * 11/1993 O'Dell et al. ..... 428/207
5,288,540 A 2/1994 Albrinck et al.
5,344,704 A 9/1994 O'Dell et al.
5,362,557 A 11/1994 Albrinck et al.
5,545,476 A * 8/1996 O'Dell et al. ..... 428/327
5,558,906 A * 9/1996 Albrinck et al. ..... 427/180
5,807,608 A * 9/1998 O'Dell et al. ..... 427/195
5,820,937 A 10/1998 Crabtree et al.
5,866,209 A * 2/1999 O'Dell et al. ..... 427/288

(Continued)

FOREIGN PATENT DOCUMENTS

EP 1063085 A1 12/2000

(Continued)

OTHER PUBLICATIONS

Chinese Office Action dated Feb. 5, 2010 pertaining to Chinese Application for Invention No. 200610093466.6.

*Primary Examiner*—Mark Ruthkosky
*Assistant Examiner*—Tamra L Amakwe
(74) *Attorney, Agent, or Firm*—Dinsmore & Shohl LLP

(57) ABSTRACT

A decorative laminate having improved scratch and abrasion resistance is provided. In one embodiment, the decorate laminate includes a substrate or core, a decorative sheet on the substrate, and an overlay sheet on the decorative sheet. The overlay sheet is coated on both major surfaces to provide scratch and abrasion resistance to the laminate. The coating on the interior facing surface contains mineral particles having a particle size of from between about 10-30 microns. The coating on the exterior facing surface contains a mixture of first mineral particles having a particle size of from between about 3-8 microns and second mineral particles having a particle size of less than about 1.0 micron. The first mineral particles are preferably alumina particles, and the second mineral particles are preferably sol gel process alumina particles.

12 Claims, 2 Drawing Sheets

U.S. PATENT DOCUMENTS 6,287,681 B1 9/2001 Mehta et al.
6,325,884 B1 12/2001 Karam
6,440,538 B1 8/2002 Ungar
6,610,777 B1 * 8/2003 Anderson et al. ..... 524/588
6,641,629 B2 11/2003 Safta et al.
6,641,926 B1 * 11/2003 Malina et al. ..... 428/524
6,656,329 B1 12/2003 Ma et al.
6,787,236 B2 9/2004 Kimura et al.

FOREIGN PATENT DOCUMENTS

TW 581727 B 4/2004

* cited by examiner

WEAR-RESISTANT DECORATIVE LAMINATES

BACKGROUND OF THE INVENTION

This invention relates generally to wear resistant decorative laminates having excellent scratch and abrasion resistance. More particularly, this invention relates to wear resistant, decorative laminates including a protective coating thereon which comprises a mixture of different sized mineral particles.

Decorative laminates are known in the art for use as surfaces for counter tops, table tops, furniture, and the like. Such decorative laminates are typically comprised of a core formed from a plurality of sheets of Kraft paper which are impregnated with a resin. Positioned above the core is a decorative sheet which is typically a cellulose pigmented paper containing a print, pattern, or solid color which may also be impregnated with a resin. The decorative sheet is generally covered with a transparent or semi-transparent protective overlay sheet comprising a cellulose paper impregnated with a phenolic resin such as melamine-formaldehyde. The overlay sheet protects the decorative sheet from abrasion, scratches, chemicals, burns, and the like.

The decorative laminates are typically made by stacking the core, decorative sheet, and overlay sheet, and then inserting the stack between pressing plates at a temperature and pressure sufficient to cause the laminating resins to flow and cure between the respective layers. When making the decorative laminates, it is often desirable to coat the back (under) side and/or the top side of the overlay sheet with a resin containing small particles of abrasive materials such as silica or alumina in order to improve the abrasion resistance of the laminate.

However, it has been found that the incorporation of such abrasive minerals into the overlay sheet can cause severe damage to the delicate, highly polished or intricately etched surfaces of the press plates. Many attempts have been made to overcome this problem. See, for example, U.S. Pat. No. 5,558,906, which teaches the use of an abrasion resistant coating comprising a thermoset resin, a mixture of alumina particles, a silane coupling agent, and a thickening agent which functions to suspend the alumina particles and protect the press plates. Others have addressed the problem by treating the surfaces of the press plates to make them more resistant to scratching. See U.S. Pat. No. 6,656,329. Still others have attempted to use smaller sized mineral particles in an effort to protect the plates. See U.S. Pat. No. 5,141,799, which teaches the use of amorphous silica powder having a particle size range from about 0.01 to 0.05 microns. However, the particles must be applied as an agglomerate having a composite size between 12 to 30 microns in order to provide sufficient abrasion resistance.

Accordingly, there is still a need in the art for a coating for use on decorative laminates which imparts scratch and abrasion resistance to the laminate but does not damage press plates during manufacture of the laminate.

SUMMARY OF THE INVENTION

Embodiments of the present invention meet that need by providing a decorative laminate that includes a coating on the exterior surface of the laminate that comprises a mixture of mineral particles having different particle sizes. Such a laminate exhibits improved glass scratch, mar, and scuff resistance as compared to prior art laminate constructions. The present invention is not limited to high pressure laminates, but also includes melamine faced chip board, thermal fused melamine laminates, and continuous pressed laminates.

According to one aspect of the present invention, a decorative laminate having resistance to abrasion and scratching is provided and comprises a substrate, a decorative sheet on the substrate, and a coating on the decorative sheet. The coating comprises a mixture of first mineral particles having a particle size of from between about 3-8 microns and second mineral particles having a particle size of less than about 1.0 micron, and a binder for said first and second mineral particles.

In a preferred form, the first and second mineral particles comprise alumina particles, with the second mineral particles comprising sol gel process alumina particles. Generally, the binder comprises a phenolic resin or a melamine formaldehyde resin.

In another embodiment, the laminate further includes an overlay sheet having first and second major surfaces. The overlay sheet is positioned between the decorative sheet and the coating of the mixture of first and second mineral particles such that the coating of the mixture of first and second mineral particles is on the second major surface of the overlay sheet. The first major surface of the overlay sheet faces the decorative sheet and also includes a coating thereon comprising mineral particles having a particle size of from between about 10-30 microns along with a binder for the mineral particles. Preferably, the mineral particles on the first major surface of the overlay sheet comprise alumina particles.

In a further embodiment, a decorative laminate having resistance to abrasion and scratching is provided and comprises a substrate, a decorative sheet on the substrate, and an overlay sheet having first and second major surfaces on the decorative sheet.

The first major surface of the overlay sheet faces the decorative sheet and includes a coating thereon comprising mineral particles having a particle size of from between about 10-30 microns and a binder for the mineral particles. The second major surface of the overlay sheet includes a coating thereon comprising a mixture of first mineral particles having a particle size of from between about 3-8 microns, second mineral particles having a particle size of less than about 1.0 micron, and a binder for the mineral particles. The binder for the mineral particles preferably comprises a phenolic resin.

Preferably, the mineral particles coated on the first and second major surfaces of the overlay sheet comprise alumina particles. The alumina particles having a particle size of less than about 1.0 micron preferably comprise sol gel process alumina.

The present invention also provides a method of making a decorative laminate having resistance to abrasion and scratching which comprises providing a substrate, providing a decorative sheet on the substrate, and providing an overlay sheet having first and second major surfaces. Preferably, the substrate is impregnated with a curable phenolic resin or melamine formaldehyde resin.

The first major surface of the overlay sheet is coated with a coating comprising mineral particles having a particle size of from between about 10-30 microns and a binder for the mineral particles. The mineral particles preferably comprise alumina particles. The second major surface of the overlay sheet is coated with a coating comprising a mixture of first mineral particles having a particle size of from between about 3-8 microns and second mineral particles having a particle size of less than about 1.0 micron, and a binder for the mineral particles. The mineral particles coated on the second major surface of the overlay sheet preferably comprise alumina particles. The alumina particles having a particle size of less than about 1.0 micron preferably comprise sol gel process alumina. The first and second major surfaces of the overlay sheet are preferably dried after coating by applying heat.

The overlay sheet is placed on the decorative sheet such that the first major surface of the overlay sheet faces the decorative sheet and such that the substrate, decorative sheet, and overlay sheet form a stack. Heat and pressure are applied to the stack in an amount sufficient to cure the binder and form the decorative laminate. The resulting decorative laminate has excellent scratch, mar, scrape and abrasion resistance.

In a further embodiment, a method of making a decorative laminate having resistance to abrasion and scratching is provided and comprises providing a substrate, providing a decorative sheet on the substrate, and coating the decorative sheet with a coating comprising a mixture of first mineral particles having a particle size of from between about 3-8 microns and second mineral particles having a particle size of less than about 1.0 micron, and a binder for the mineral particles. The decorative sheet is placed on the substrate to form a stack, and heat and pressure are applied to the stack in an amount sufficient to cure the binder and form the laminate.

The substrate is preferably impregnated with a resin prior to forming the stack. Preferably, the mixture of the first and second mineral particles comprise alumina particles, and the second mineral particles comprise sol gel process alumina particles. Generally, the binder for the mineral particles comprises a phenolic resin or a melamine formaldehyde resin.

In yet another embodiment, a method of making a decorative laminate having resistance to abrasion and scratching is provided and comprises providing a substrate, providing a decorative sheet on the substrate, providing an overlay sheet having first and second major surfaces, coating the first major surface of the overlay sheet with a coating comprising mineral particles having a particle size of from between about 10-30 microns and a binder for said mineral particles, and coating the second major surface of the overlay sheet with a coating comprising a mixture of first mineral particles having a particle size of from between about 3-8 microns and second mineral particles having a particle size of less than about 1.0 micron, and a binder for the mineral particles. The overlay sheet is placed on the decorative sheet such that the first major surface of the overlay sheet faces the decorative sheet and such that the substrate, decorative sheet, and overlay sheet form a stack. Heat and pressure are applied to the stack in an amount sufficient to cure the binder and form the laminate.

In a preferred form, the method includes applying heat to the first and second major surfaces of the overlay sheet prior to placing the overlay sheet on the decorative sheet. Also, the substrate is preferably impregnated with a resin prior to forming the stack. Preferably, the mineral particles coated on the first major surface of the overlay sheet comprise alumina particles, and the mineral particles coated on the second major surface of the overlay sheet comprise alumina particles.

Accordingly, it is a feature of embodiments of the present invention to provide a decorative laminate including a coating thereon which provides resistance to abrasion and scratching and which comprises different sized mineral particles. These, and other features and advantages of embodiment of the present invention will become apparent from the following detailed description, the accompanying drawings, and the appended claims.

DETAILED DESCRIPTION OF THE PREFERRED EMBODIMENTS

We have found that improved scratch and abrasion resistance, specifically improved glass scratch, mar, and scuff resistance, can be provided to decorative laminates by providing a coating of mineral particles on both sides of the overlay sheet, where the coating on the top (exterior-facing) side of the sheet comprises a mixture of mineral particles having a particle size of from between about 3-8 microns and mineral particles having a particle size of less than about 1.0 micron. Preferably, the particle size is between about 0.2 and 0.5 micron. Further, the exterior-facing coating imparts enhanced protection against scratching of the polished metal press plates used to form the laminate. Without wishing to be limited to a specific theory, it is believed that the mixture of larger and very small particles almost immediately forms a tough, hydrophobic film on top of the resin binder when applied to the laminate.

Further, in a preferred embodiment of the invention, the smaller mineral particles comprise sol gel process alumina. Again, without wishing to be limited a particular theory, it is believed that traces of nitric acid used in typical washing processes during sol gel formation of the particles, act as a catalyst for the resin binder and promote enhanced localized curing of the resin. This is believed to result in a tougher cured resin which renders the laminate more resistant to scratching and marring. Further, the smaller sol gel process particles are believed to form a film that entraps the larger mineral particles in the film at the surface of the laminate. These larger particles are also believed to contribute to the resulting improvement in scratch and mar resistance of the laminate.

Figure 1:
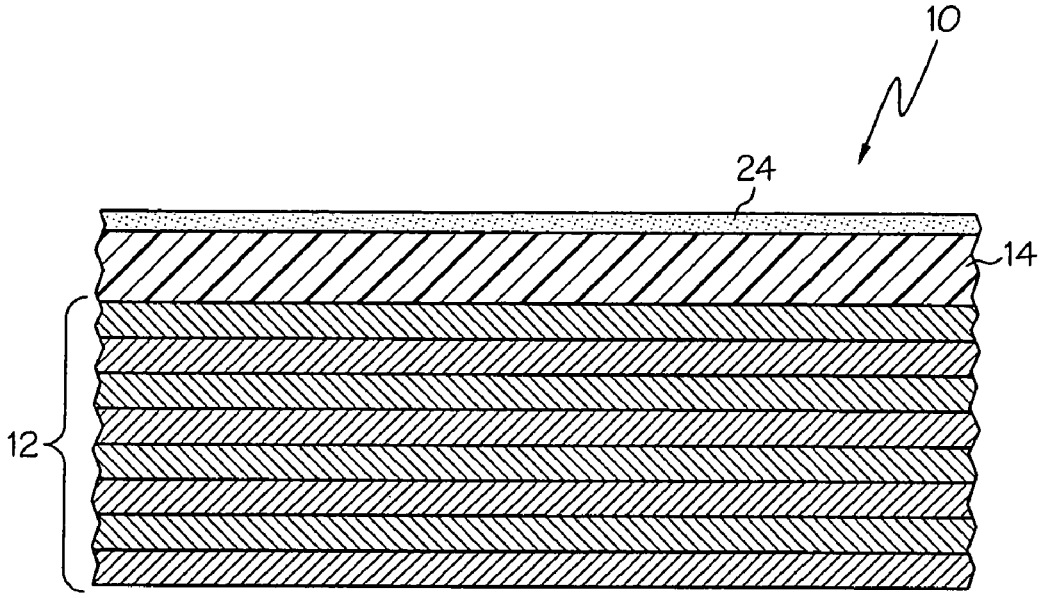
FIG. 1 is a cross-sectional view of one embodiment of the decorative laminate of the present invention.

Referring now to FIG. 1, one embodiment of the decorative laminate 10 of the present invention is shown. This embodiment is useful when the decorative sheet is a solid color, and an overlay sheet may be omitted. The laminate comprises a substrate 12, a decorative sheet 14 on the substrate, and a mineral particle-filled cured resin coating layer 24.

As shown, the substrate or core 12 of the decorative laminate is preferably comprised of one or more layers of paper sheets such as Kraft paper which have been impregnated with a liquid thermosetting resin such as a phenolic resin or a melamine formaldehyde resin. The substrate or core provides a reinforcing structural base to the laminate. The substrate may also include one or more additional layers such as bleached Kraft paper, mineral fiber cement board, MDF board, and any other material used in the industry. A preferred structure for the substrate layer is from about 2-100 sheets of 40-300 g/m$^2$ basis weight Kraft paper impregnated with a phenolic resin, a melamine formaldehyde resin, or blends thereof. Typically, the resin will have a solids content of from about 20 to about 40% based on the total weight of the core.

The decorative sheet 14 in this embodiment is a pigmented solid color sheet comprised of cellulose and having a basis weight in the range of from about 55 to about 200 gm/m$^2$. Decorative sheet 14 may also optionally be impregnated with a curable resin.

The exterior facing surface of decorative sheet 14 is coated with a coating 24 comprising a mixture of first alumina particles having a particle size of from between about 3-8 microns and second alumina particles having a particle size of less than about 1.0 micron, preferably from about 0.1 to 1.0, and most preferably from about 0.3 to about 0.5 microns, and a binder for the particles. Generally, the resin binder will comprise a melamine formaldehyde resin. The first alumina particles are commercially available from Micro Abrasives Corp., Westfield, Mass., under the trade name Microgrit. The second alumina particles preferably comprise sol gel process alumina, which is commercially available from Sasol North America, Houston, Tex. under the trade name Sol DISPAL. The alumina particles made by a sol gel process most preferably have a particle size of about 0.5 microns. The coating containing the mixture of alumina particles is preferably prepared by mixing the larger and smaller particles with the resin binder using substantially constant agitation to evenly disperse the particles in the binder.

Figure 2:
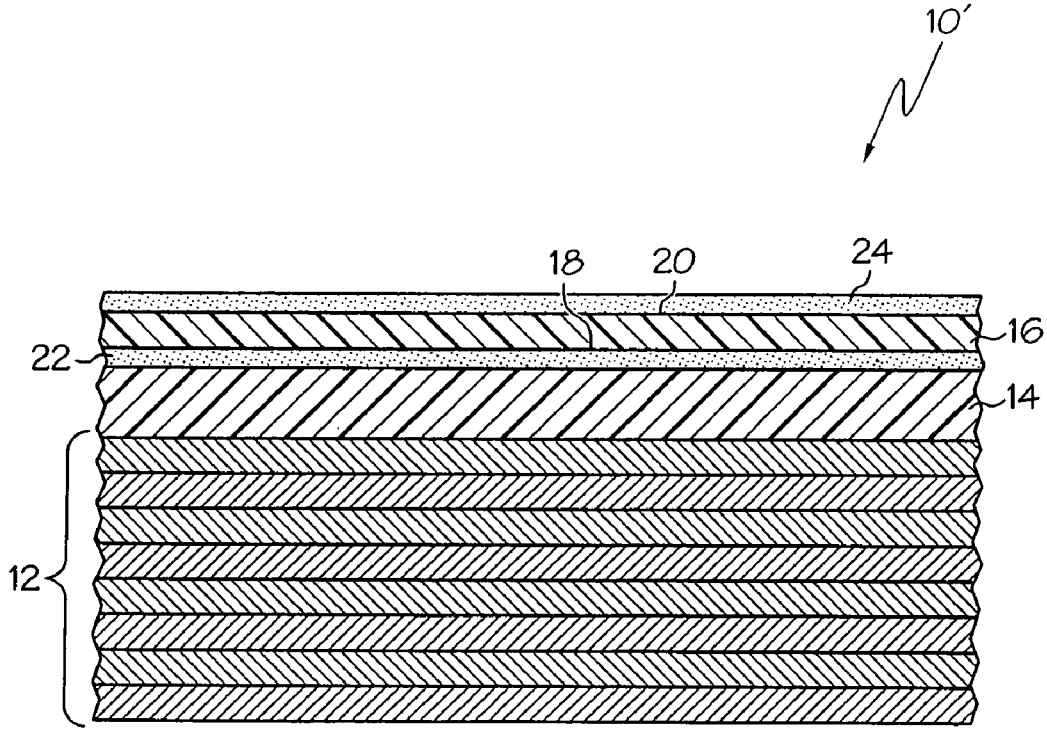
FIG. 2 is a cross-sectional view of another embodiment of the decorative laminate of the present invention.

Referring now to FIG. 2, another embodiment of decorative laminate 10' is shown. In this embodiment, the laminate comprises a substrate 12, a decorative sheet 14 on the substrate, and an overlay sheet 16. As previously described, substrate 12 includes one or more sheets that have been impregnated with a resin. In this embodiment, decorative sheet 14 comprises a cellulosic sheet printed with a decorative pattern or design. Overlay sheet 16 preferably comprises a cellulose paper sheet which includes a first surface 18 and second surface 20.

The first surface 18 of the overlay sheet includes a coating 22 comprising mineral particles having a particle size of from between about 10-30 microns and a binder for the mineral particles. Preferred mineral particles for use in the present invention are alumina particles. Alumina particles having a particle size of from 10-30 microns are commercially available from Micro Abrasive Corp. The binder is preferably a phenolic or melamine formaldehyde resin. Such resins are commercially available from a number of manufacturers including Borden Chemicals and Dynea International Oy. The coating is preferably prepared by mixing the alumina particles and resin binder with agitation to disperse the particles evenly throughout the resin.

Figure 3:
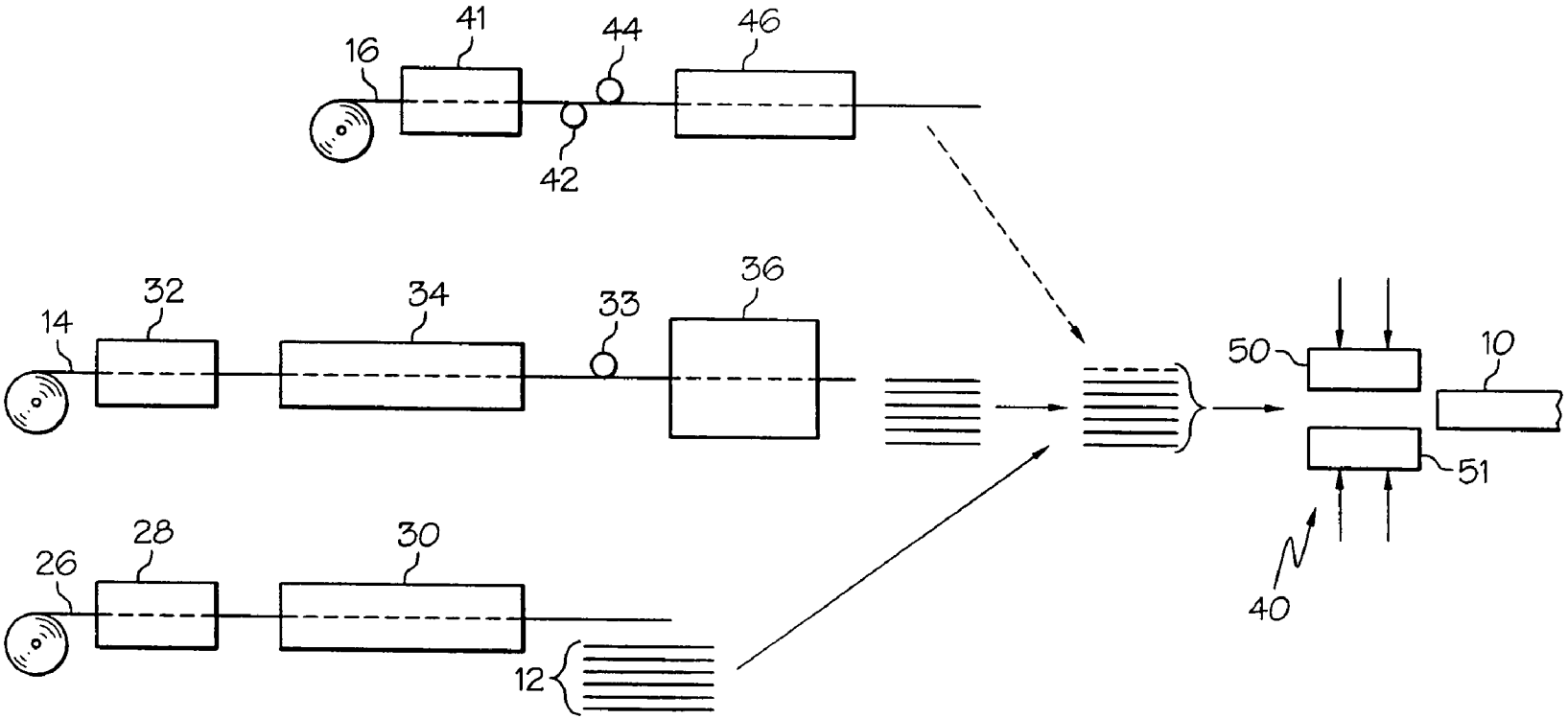
FIG. 3 is a schematic illustration of a method of making one embodiment of the decorative laminate of the present invention.

FIG. 3 illustrates an embodiment of the method of making the decorative laminate of the present invention which is shown as a continuous process. However, it is contemplated that individual layers in the laminate may be produced at separate times (and even at separate locations) and stored prior to being formed into the final laminate. As shown, the substrate 12 is formed by impregnating a web of Kraft paper 26 (or other suitable core material as described above) with a liquid resin. Typically, the liquid resin is supplied as an aqueous solution containing about 40-60% resin solids. The paper 26 is fed in a continuous manner and impregnated with resin at station 28. A number of conventional impregnation techniques may be utilized including immersion or dip coating of paper 26. After impregnation, the paper web 26 is preferably at least partially dried in a hot air oven 30 to drive off volatiles. Web 26 is then cut into individual sheets 12 to form the core or substrate portion of the laminate.

Decorative sheet 14 is also supplied from a roll of material as a continuous web. In the embodiment shown, decorative sheet 14 comprises a solid pigmented color material. Decorative sheet 14 is impregnated with liquid resin at coating station 32, followed by at least partial drying in a hot air oven 34. As shown in FIG. 3, the top (exterior facing) surface of decorative sheet 14 is then coated with a mixture of first alumina particles having a particle size of from between about 3-8 microns and second alumina particles having a particle size of less than about 1.0 micron, preferably from about 0.1 to 1.0, and most preferably from about 0.3 to about 0.5 microns, and a resin binder for the particles as previously described.

The particles dispersed in the resin binder are applied using a wire-wound metering rod 33 (also known as a Meyer rod or bar). Other coating techniques may be used. The coating is applied to provide a final coating having a dry basis weight of from about 15 to about 30 g/m$^2$. Preferably, the coating is supplied as particles of alumina or corundum in an approximately 1%-10% aqueous resin solution. The coated web is dried in a hot air oven 36 to drive off volatile components. The coated web is then cut into individual decorative sheets 14. A decorative sheet is then assembled in a stack with multiple substrate sheets 12. The stack is then cured to its final laminate form using heat and pressure at curing station 40. Typically, curing station 40 will include an opposing pair of polished metal press plates, 50, 51.

Optionally, the laminate may include an overlay sheet 16. This embodiment is shown using a phantom line in FIG. 3 to add the overlay sheet to the stack. If an overlay sheet is used, then decorative sheet 14 is impregnated with resin, but not coated with the mixture of alumina particles. Rather, as shown, overlay sheet 16 is supplied as a continuous web from a roll of material and is impregnated with a liquid resin at station 41 the impregnated web is then fed between coating rods 42, 44 such that the first (interior facing) surface is coated with coating from rod 42 and the second (exterior facing) surface is coated with coating from roller 44.

The coating from rod 42 comprises mineral particles having a particle size of from between about 10-30 microns dispersed in a liquid resin binder for the mineral particles. The coating is preferably applied at a coat weight to provide a final dried coating weight of from between about 10 to about 30 g/m$^2$. The coating from rod 44 comprises the mixture of different sized mineral particles dispersed in a liquid resin binder as described above. The coating from rod 44 is applied to provide a final dried coat weight of from about 15 to about 30 g/m$^2$. The overlay sheet 16 is then at least partially dried in a hot air oven 46 to drive off volatile components.

The coated web is then cut into individual overlay sheets 16 and, in this alternative embodiment, an overlay sheet is placed on top of the substrate and decorative layers 12 and 14. The stack is then placed between press plates 50, 51 at curing station 40 under heat and pressure to cure the resin in each of the layers and form the finished laminate 10.

In order that the invention may be more readily understood, reference is made to the following example which is intended to be illustrative of specific embodiments of the invention, but is not intended to be limiting in scope.

EXAMPLE 1

Laminates were prepared in accordance with an embodiment of the present invention the laminates included a substrate layer comprised of multiple sheets of resin-impregnated Kraft paper, a cellulosic decorative sheet, and an overlay sheet having scratch and abrasion resistant coatings on its first (interior facing) and second (exterior facing) surfaces with the following formulations: The first surface coating included alumina particles having an average particle size of about 15 microns dispersed in a melamine formaldehyde resin (50% resin solids/50% water). The coating was applied to provide a final dried coat weight of about 17 g/m$^2$. The second surface coating included a mixture of alumina particles, the first alumina particles having an average particle size of about 3 microns, and the second alumina particles having an average particle size of about 0.5 microns. The alumina particles were dispersed in a melamine formaldehyde resin (50% resin solids/50% water). The coating was applied to provide a final coat weight of 22 g/m$^2$.

Each of the laminate samples prepared above was subjected to the following test procedures:

Glass Scratch Test

This test measured the ease with which a laminate could be scratched using a material of similar sharpness and hardness to ordinary silica, the usual scratching component in airborne dirt. The test was carried out pursuant to the procedures used in the National Electrical Manufacturers Association (NEMA) Linear Glass Scratch Resistance test (LD3-2000). For comparison purposes, a conventional laminate having a melamine formaldehyde resin top coat, but no mineral particles, was also tested. The laminate surfaces were observed visually after being scratched with the edge of a glass slide mounted in a scratch tool fixture to which different loads could be applied. The conventional laminate could withstand a load of only 1040 grams before visible scratch marks were observed. The laminate made in accordance with an embodiment of the present invention as described above did not exhibit visible scratch marks until the load was increased to 150-200 grams or above.

Diamond Scratch Test

This test measured the ability of the surface of the decorative laminate to resist scratching in accordance with European Standard EN 438-1. A load was applied to a diamond point mounted to a fixture which made a circular motion on the surface of a laminate sample. Again, for comparison purposes, a conventional laminate having a melamine formaldehyde resin top coat, but no mineral particles, was also tested. The laminate surface were observed visually after being scratched. For the test, dark-colored decorative laminates were used. Scratch marks are more readily perceived when viewing a darker surface. The conventional laminate showed visible scratch marks with an applied force of 1.5-1.75 Newtons. The laminate made in accordance with an embodiment of the present invention as described above did not exhibit visible scratch marks until the force applied reached 2.25-2.5 Newtons.

Mar Resistance Test

The mar resistance of a conventional laminate sample and a laminate prepared in accordance with an embodiment of the present invention as described above were determined by rubbing the laminate surface under controlled conditions with an abrasive pad (ScotchBrite® brand), and then measuring the change in surface gloss of the marred area as compared with the original surface gloss. The change in surface gloss was measured by a standard glossmeter. After 5 rubs using the abrasive pad, the conventional laminate exhibited a measured 15-20% reduction in gloss. After 5 rubs, the laminate of the present invention exhibited less than a 5% reduction in gloss.

In the foregoing specification, the invention has been described with reference to specific embodiments. However, one of ordinary skill in the art appreciates that various modifications and changes can be made without departing from the skill of the present invention as set forth in the claims below. Accordingly, the specification and figures are to be regarded in an illustrative rather than a restrictive sense, and all such modifications are intended to be included within the scope of the present invention.

What is claimed is:

1. A decorative laminate having resistance to abrasion and scratching comprising:

a substrate;

a decorative sheet on said substrate; and a coating on said decorative sheet; said coating consisting essentially of a mixture of first mineral particles having a particle size of from between about 3-8 microns, and second mineral particles having a particle size of less than about 1.0 micron, and a binder for said first and second mineral particles, said second mineral particles forming a film at the surface of said laminate and entrapping said first mineral particles therein.

2. A decorative laminate as claimed in claim 1 wherein said first and second mineral particles comprise alumina particles.

3. A decorative laminate as claimed in claim 2 wherein said second mineral particles comprise sol gel process alumina particles.

4. A decorative laminate as claimed in claim 1 wherein said binder comprises a phenolic resin or a melamine formaldehyde resin.

5. A decorative laminate as claimed in claim 1 further including an overlay sheet having first and second major surfaces, said overlay sheet being positioned between said decorative sheet and said coating of a mixture of first and second mineral particles such that said coating of a mixture of first and second mineral particles is on said second major surface of said overlay sheet; said first major surface of said overlay sheet faces said decorative sheet and includes a coating thereon, said coating comprising mineral particles having a particle size of from between about 10-30 microns and a binder for said mineral particles.

6. A decorative laminate as claimed in claim 5 wherein said mineral particles comprising a coating on said first major surface of said overlay sheet comprise alumina particles.

7. A decorative laminate having resistance to abrasion and scratching comprising:

a substrate;

a decorative sheet on said substrate; and an overlay sheet having first and second major surfaces on said decorative sheet; said first major surface of said overlay sheet facing said decorative sheet and including a coating thereon; said coating comprising mineral particles having a particle size of from between about 10-30 microns and a binder for said mineral particles; said second major surface of said overlay sheet including a coating thereon consisting essentially of a mixture of first mineral particles having a particle size of from between about 3-8 microns, and second mineral particles having a particle size of less than about 1.0 micron, and a binder for said mineral particles.

8. A decorative laminate as claimed in claim 7 wherein said mineral particles coated on said first major surface of said overlay sheet comprise alumina particles.

9. A decorative laminate as claimed in claim 7 wherein said mineral particles coated on said second major surface of said overlay sheet comprise alumina particles.

10. A decorative laminate as claimed in claim 9 wherein said alumina particles having a particle size of less than about 1.0 micron comprise sol gel process alumina.

11. A decorative laminate as claimed in claim 7 wherein said binder comprises a phenolic resin.

12. A decorative laminate as claimed in claim 3 wherein said sol gel process alumina particles include traces of acid which catalyze the cure of said binder.

* * * * *